US008499771B1

(12) United States Patent
Auda et al.

(10) Patent No.: US 8,499,771 B1
(45) Date of Patent: Aug. 6, 2013

(54) FINGERNAIL POLISH PROTECTOR

(76) Inventors: Michelle Lynn Auda, Atlanta, GA (US); Andrew John Shearer, Depew, NY (US)

( * ) Notice: Subject to any disclaimer, the term of this patent is extended or adjusted under 35 U.S.C. 154(b) by 0 days.

(21) Appl. No.: 12/904,144

(22) Filed: Oct. 13, 2010

Related U.S. Application Data

(60) Provisional application No. 61/278,720, filed on Oct. 13, 2009.

(51) Int. Cl.

| | |
|---|---|
| ***A45D 29/00*** | (2006.01) |
| ***A45D 29/18*** | (2006.01) |
| ***B26B 13/22*** | (2006.01) |
| ***A44C 13/00*** | (2006.01) |
| ***A44C 25/00*** | (2006.01) |
| ***A41D 13/08*** | (2006.01) |

(52) U.S. Cl.
USPC ..... 132/285; 132/73; 132/73.5; 63/1.11; 63/33; 63/42; 2/21

(58) Field of Classification Search
USPC ..... 132/285, 73, 129, 132, 133, 73.5, 132/76.5, 319, 333, 76.2; 24/20 TT, 484; 2/21, 16, 20, 161.7, 158, 159, 160, 163; 602/5, 602/6, 12, 21, 22, 30, 31; 63/3, 3.1, 3.2, 63/6.7, 10, 15, 15.5, 15.6, 15.7, 15.8, 15.65, 63/15.45, 29.1, 1.11, 33, 1.12, 40, 41, 42, 63/7, 426, 6; D28/56, 57, 62; D11/26, 27; 16/342, 343
See application file for complete search history.

(56) References Cited

U.S. PATENT DOCUMENTS

| | | | | | |
|---|---|---|---|---|---|
| 293,831 | A | * | 2/1884 | Wickers | 2/21 |
| 945,107 | A | * | 1/1910 | Moodey | 63/15.7 |
| 1,995,772 | A | * | 3/1935 | Jacobs | 296/97.13 |
| 2,179,046 | A | * | 11/1939 | Lewis | 2/21 |
| 2,251,551 | A | * | 8/1941 | O'Reilly | 2/21 |
| 2,297,807 | A | * | 10/1942 | Sommers | 2/21 |
| 2,487,101 | A | * | 11/1949 | Colby et al. | 2/21 |
| 2,546,619 | A | * | 3/1951 | Turner | 2/21 |
| 3,543,535 | A | * | 12/1970 | Siegel et al. | 63/29.1 |
| 3,913,187 | A | * | 10/1975 | Okuda | 24/484 |
| 3,930,510 | A | * | 1/1976 | Johnston | 131/258 |
| 4,089,066 | A | * | 5/1978 | Dethman | 2/21 |
| 4,183,120 | A | * | 1/1980 | Thorne | 24/16 R |
| 4,615,464 | A | * | 10/1986 | Byrns | 220/4.23 |
| 4,881,301 | A | * | 11/1989 | Sweeney et al. | 24/30.5 R |
| 4,935,992 | A | * | 6/1990 | Due | 24/16 R |
| 4,966,174 | A | * | 10/1990 | Stanczak | 132/73 |
| 4,984,592 | A | * | 1/1991 | Hellein | 132/285 |
| 5,085,234 | A | * | 2/1992 | Silverman | 132/73 |

(Continued)

*Primary Examiner* — Vanitha Elgart
(74) *Attorney, Agent, or Firm* — Sanford Jay Asman

(57) ABSTRACT

The fingernail polish protector includes an adjustable ring portion along with a ventilated protective shield which snaps into the adjustable ring portion. The adjustable ring portion is designed to fit over the distal end of the finger of a wearer whose fingernail has been recently polished such that the ventilated protective portion overlies the fingernail thereby protecting the polish from being damaged while it dries and cures. Ventilation openings allow airflow and can be formed to be both functional and decorative. A positive stop prevents the ventilated protective shield from tilting downward onto a wet nail, while downward curved sides of the shield limit side-to-side movement which also helps prevent damaging newly polished fingernails. A plastic injection molding process allows the two interlocking portions to be formed in various sizes and colors.

11 Claims, 3 Drawing Sheets

U.S. PATENT DOCUMENTS 5,186,189 A * 2/1993 Harris ..... 132/285
5,216,784 A * 6/1993 Dyer ..... 24/20 TT
5,232,436 A * 8/1993 Janevski ..... 602/22
5,282,276 A * 2/1994 Preiose ..... 2/21
5,540,243 A * 7/1996 Simonton ..... 132/73
5,699,816 A * 12/1997 Banes et al. ..... 132/285
5,743,277 A * 4/1998 Moreshead ..... 132/200
5,803,094 A * 9/1998 Becker et al. ..... 132/200
5,924,428 A * 7/1999 Song ..... 132/285
6,085,550 A * 7/2000 Ishida ..... 63/15.65
6,266,852 B1 * 7/2001 Tai ..... 24/16 PB
6,490,886 B1 * 12/2002 Steinhauer et al. ..... 63/15
6,926,363 B2 * 8/2005 Yamashita ..... 297/366
7,107,789 B1 * 9/2006 Bruner ..... 63/15.7
7,284,302 B2 * 10/2007 Lares ..... 24/16 PB
7,685,683 B2 * 3/2010 Coles et al. ..... 24/16 PB
2002/0059940 A1 * 5/2002 Cain-Kozma ..... 132/73
2003/0177787 A1 * 9/2003 Kuo ..... 63/15.45
2009/0308103 A1 * 12/2009 Chang ..... 63/15.6
2011/0108045 A1 * 5/2011 Racz ..... 132/73
2011/0179823 A1 * 7/2011 Moody ..... 63/4

* cited by examiner

FINGERNAIL POLISH PROTECTOR

CROSS-REFERENCE TO RELATED APPLICATION(S)

The present application claims the priority of U.S. provisional application Ser. No. 61/278,720, filed Oct. 13, 2009 entitled POLISH PROTECTORS.

BACKGROUND OF THE INVENTION

The present invention relates to a fingernail polish protection device for use in protecting wet fingernail polish while it is drying. In particular, the invention relates to a device having an adjustable ring member and a ventilated shield member, wherein the ventilated shield protects the fingernail polish while allowing air circulation to help the polish dry.

Previously, it has been well known to attach coverings or protective devices to fingers to protect wet fingernail polish or paint as it dries. However, the devices heretofore known lacked all of the attributes necessary to be wholly effective. Accordingly, few of the prior known devices have ever been introduced into the mass market, as they were visually unappealing, expensive to manufacture, and subject to several practical disadvantages.

Many of the previously known devices were difficult to use. For example, if a device is too bulky (i.e., too long and/or too wide or thick), it is awkward to affix to the fingers, particularly since fingernails are often polished in a set, meaning that such devices are placed on adjacent fingers By way of example, prior designs which appear to be extremely difficult to use include the ones described in U.S. Pat. No. 2,458,709 entitled Fingernail Guard which issued to J. H. Kayer on Jan. 11, 1949 and in U.S. Pat. No. 2,557,759 entitled Fingernail Polish Guard which issued to L. Pfister on Jun. 19, 1951.

Also, such devices can be uncomfortable to wear. By way of example, devices which incorporate semi-circular rings or clips can pinch the fingers and cause swelling, discomfort, and loss of circulation. Such devices are described in U.S. Pat. No. 2,297,807 entitled Fingernail Bonnet which issued to F. Sommers on Oct. 6, 1942; U.S. Pat. No. 2,323,854 entitled Fingernail Guard which issued to S. Silverman on Jul. 6, 1943; U.S. Pat. No. 2,546,619 entitled Fingernail Guard which issued to H. H. Turner on Mar. 27, 1951; U.S. Pat. No. 4,089,066 entitled Fingernail Protector which issued to M. L Dethman on May 16, 1978; U.S. Pat. No. 4,966,174 entitled Fingernail Protector which issued to J. J. Stanczak on Oct. 30, 1990; U.S. Pat. No. 5,282,276 entitled Fingernail Protector which issued to M. Preziose on Feb. 1, 1994; U.S. Pat. No. 5,540,243 entitled Fingernail Protector which issued to C. A. Simonton on Jul. 30, 1996; U.S. patent application Ser. No. 12/102,124 entitled Nail Protection Apparatus which was published by L. Giachetti as US2009/0255545A1 on Oct. 15, 2009; U.S. patent application Ser. No. 12/422,380 entitled Nail Protection Apparatus which was published by L. Giachetti as US2009/0255545A1 on Oct. 15, 2009. As will be obvious to those skilled in the art, if the device is uncomfortable, in addition to potentially experiencing injury, the wearer will not be able to achieve the full benefit of the device as they may have to remove it before their fingernails are completely dry.

Other devices, as shown in U.S. Pat. No. 2,179,046 entitled Fingernail Polish Protector which issued to H. B. Lewis on Nov. 7, 1939 and in U.S. Pat. No. 3,967,631 entitled Fingernail Cap which issued to K. M. Kosal on Jul. 6, 1976, were ill-fitting and not adjustable. Further, such devices extended over the tip of the finger, whereby the wearer's ability to use her finger was highly diminished, while the devices described had a fixed length whereby the length of a wearer's fingernail had to be limited by the device's configuration.

Many of the devices of the prior art were ill-fitting, as they cannot be sized to the exact dimensions of the wearer's finger. Accordingly, absent some way to customize the ring fitting, such devices were uncomfortable to wear, as a too tight device would pinch and cut off circulation, resulting in discomfort, while devices where were too loose would move about, allowing their "protective" portion to tilt downward onto the fingernail, thereby damaging the freshly painted fingernails which they were intended to protect.

While the issue of customizable sizing was addressed in U.S. Pat. No. 4,089,066 of M. L. Dethman (See, above) and in U.S. Pat. No. 5,699,816 entitled Fingernail Protector which issued to C. A. Banes, et al. on Dec. 23, 1997, neither of those disclosures taught anything about separating the shield portion of a fingernail polish protector from the adjustable portion ("the ring portion"). Accordingly, while those inventions addressed the issue of customizable fit and finger comfort associated with making a fingernail polish protection device, neither of them addressed the issues of polish protection, ventilation, or overall fit, all of which are required to have a truly viable fingernail polish protection device.

In that the prior known devices failed to provide for ventilation needed to promote the drying and curing of the fingernail polish they were inadequate to accomplish the result required. Thus, such devices as those shown in U.S. Pat. No. 5,699,816 of C. A. Banes, et al. (See, above); U.S. Pat. No. 2,487,101 entitled Fingernail Protector which issued to R. E. Colby, et al. on Nov. 8, 1949; U.S. Pat. No. 4,972,857 entitled Fingernail Polish Protector which issued to L. A. Stewart, et al. on Nov. 27, 1990; and U.S. Pat. No. 4,665,934 entitled Fingernail Guard which issued to N. E. Jefferson on May 19, 1987. As will be readily understood, designs that do not incorporate ventilation slits or holes at least partially mask the fingernail, typically resulting in increased drying time.

Many of the prior known devices prevent mobility, requiring the wearer to remain stationary while the fingernails dry. Such devices do not offer much benefit as compared to a person who simply remains stationary without wearing any type of protective device. Prior designs which appear to inhibit wearer mobility include those described in U.S. Pat. No. 2,251,551 entitled Nail Polish Protector which issued to M. B. O'Reilly on Aug. 5, 1941; in U.S. Pat. No. 2,179,046 (See, above); and in U.S. Pat. No. 6,302,116 entitled Fingernail Protection Device which issued to H. A. Copeland on Oct. 16, 2001.

SUMMARY OF THE INVENTION

Unlike the designs of the prior art, the present invention is a fingernail polish protector which is comfortable to wear, as it includes an easily adjustable ring portion. It also includes a detachable, tiltable polish protector which includes ventilation openings, whereby the fingernail polish is protected, yet it is able to receive air flow to dry properly.

In addition to providing an improved and marketable form of a fingernail polish protector, the invention provides a fingernail protector that effectively and comfortably protects wet fingernail polish as it dries. The current invention thus provides for a proper fit, allows ventilation for the drying process, and it is easy to use, while permitting the wearer to use her hands and fingers while wearing the device.

This invention comprises novel details of construction and novel combinations of parts. Other objects, features, and advantages of the invention will be apparent from the following detailed disclosure, taken in conjunction with the accompanying drawings, wherein like reference numerals refer to like parts.

DETAILED DESCRIPTION OF THE PREFERRED EMBODIMENT

Figure 1:
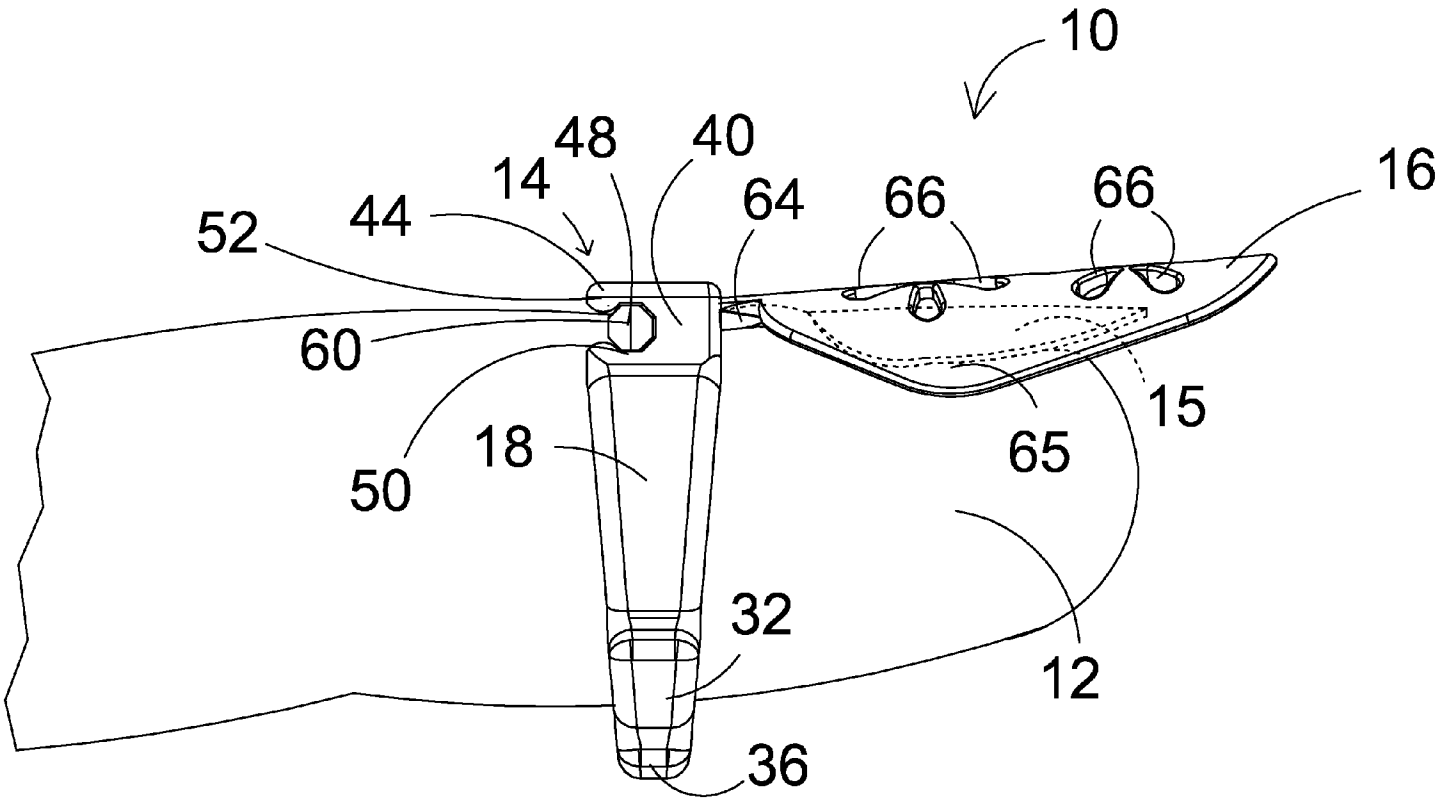
FIG. 1 is side view of the fingernail polish protector of the present invention, shown applied to a wearer's finger and overlying a recently polished nail (shown in shadow)

Referring to FIG. 1 a side view of the preferred embodiment of the fingernail polish protector 10 of the present invention, is shown being worn on a finger 12 of a wearer on which a fingernail 15 (shown in shadow) has been recently polished.

In accordance with the invention, the preferred embodiment 10 includes a ring portion 14 and a shield portion 16. Unlike the known prior art, the ring portion 14 is highly adjustable, yet easily removable, while the shield portion 16 is tiltably adjustable to provide both protection to, and clearance from, the wearer's fingernail 15.

Figure 2:
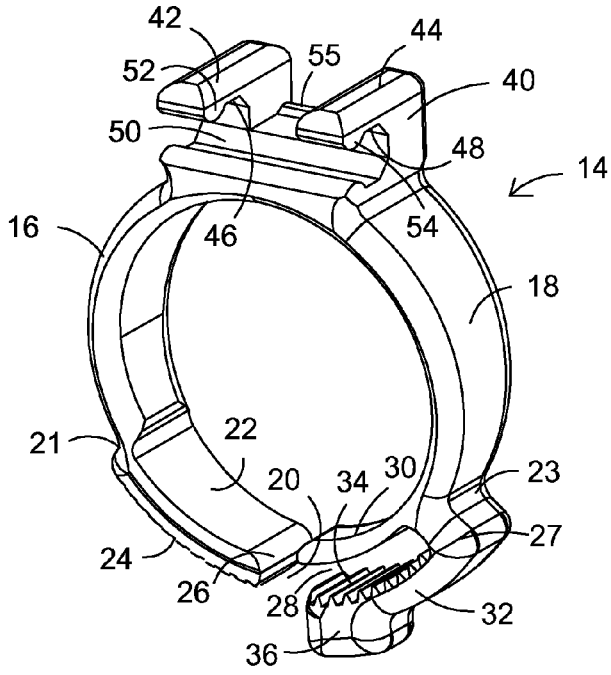
FIG. 2 is a perspective view of the ring portion of the fingernail polish protector of the present invention.
Figure 3:
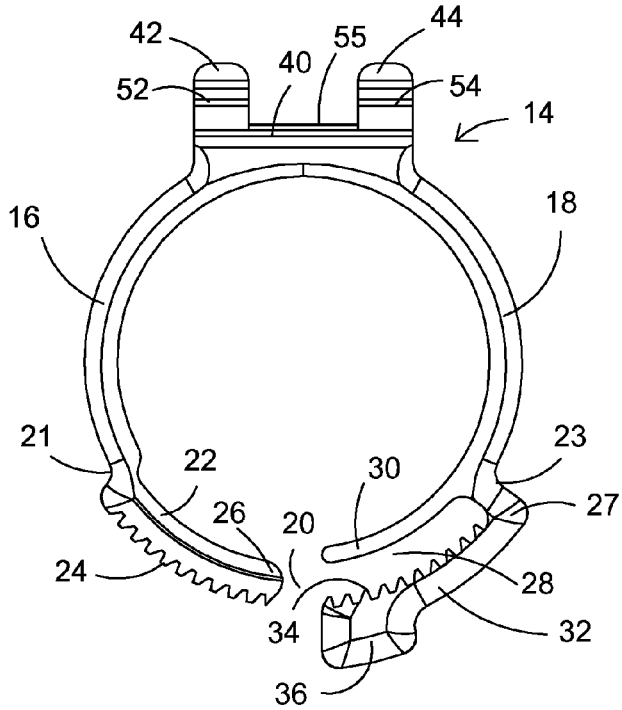
FIG. 3 is rear view of the ring portion of the fingernail polish protector of the present invention.

With reference to FIGS. 2 and 3, the ring portion 14 is shown to include a generally circular, open ring having two arcuate sections 16, 18 with an opening 20 therebetween. At the distal end 21 of the first arcuate portion 16 there is a slidable member 22 having a ridged surface 24 formed on an outer portion thereof. As shown, the slidable member 22 preferably includes a somewhat rounded distal end 26.

At the distal end 23 of the second arcuate section 18 a forked portion 27 is formed, whereby an elongated opening 28, extending between an inner portion 30 and an outer portion 32, is formed therein. As shown in FIGS. 2 and 3, a ridged surface 34 extends along the inside of the outer portion 32, whereby the slidable member 22 can be introduced into the elongated opening 28 such that the respective ridged sections 24, 34, which are "sawtoothed" in the preferred embodiment, juxtapose and interconnect. To assist such interconnection, the elongated opening 28 has a width which is slightly less than the width of the slideable member 22, whereby the inner and outer portions 30, 32 trap the slideable member 22 when it is therebetween.

To assist movement and removal of the slideable member 22, a release 36 is formed at the distal end of the outer portion 32, whereby the release 36 can be used to urge the ridged portions 24, 34 apart, so that the arcuate sections 16, 18 can be adjusted to be either tighter or looser, as desired, on the wearer's finger 12.

With continued reference to FIGS. 2 and 3, the ring portion 14 further includes a shield mounting portion 40 formed on the ring portion 14 opposite the opening 20, such that the opening 20 and the adjustment means comprising the sections 24, 34 and portions 28, 30, 32, 36 are generally on the (bottom) side of the finger 12 opposed from the nail, while the shield mounting portion 40 is proximate to the nail to be protected (which is on the top side of the finger 12).

As shown in FIG. 1-3, and as will be explained hereinafter, in the preferred embodiment of the invention 10, the shield mounting portion 40 is designed to be able to capture a rotatable axle 60 within a pair of arms 42, 44, each having an arcuate opening formed on its lower portion, with the arcuate openings 46, 48, overlying an arcuate trough 50. As shown, the ends 52, 54 of the arcuate openings 46, 48 are formed in such a manner that there will be a frictional pressure fit, when the axle 60 (associated with the shield portion 16) is pressed therein. As will be further explained hereinafter, the shield mounting portion 40 further includes a positive stop feature 55, which (as explained below) interacts with the lower portion of the elongated arm 64 of the curved protective shield 62 to limit the downward travel of the curved protective shield 62, preventing it from making contact with a wet fingernail.

Figure 4:
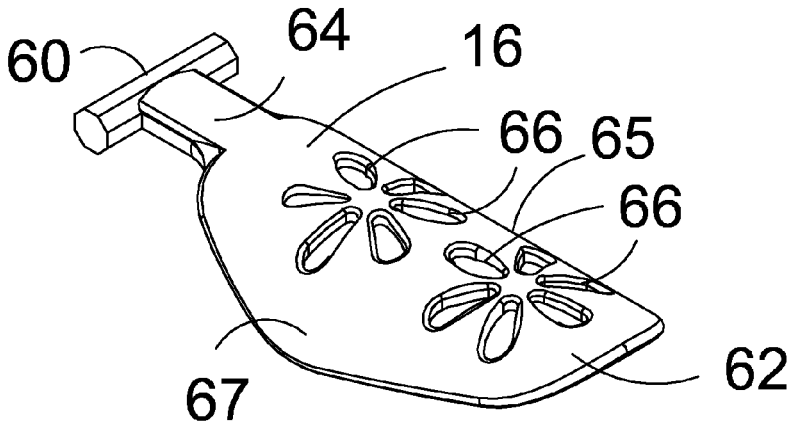
FIG. 4 is a perspective view of the shield portion of the fingernail polish protector of the present.
Figure 5:
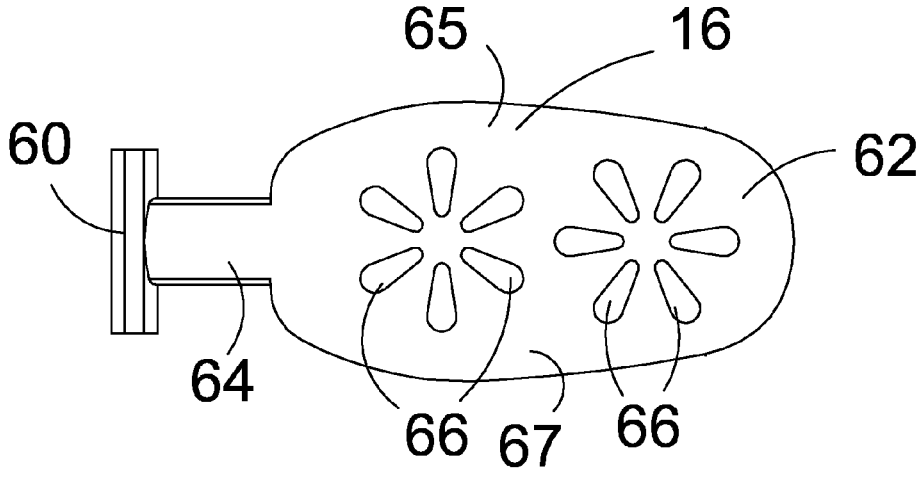
FIG. 5 is top view of the fingernail polish protector of the present invention.

With reference, now, to FIGS. 4 and 5, the shield portion 16 includes a curved protective shield 62 which is connected to the aforementioned axle 60 by an elongated arm 64. The curved protective shield is preferably in the general shape of a fingernail, and it includes a plurality of ventilation openings 66 which may be formed in any desired pattern, e.g., such as the flower petal pattern illustrated in FIGS. 1, 4, and 5. As described above, the downward travel of the curved protective shield 62 is limited by the positive stop 55, which prevents it from tilting downward to the fingernail 15, thereby preventing it from damaging a newly polished fingernail. In addition, the downward curved portions 65, 67 on either side of the curved protective shield 62 limit side to side movement, as they will contact the wearer's finger preventing contact with, and damage to, a newly polished fingernail 15.

As will be understood by those skilled in the art, both the ring portion 14 and the shield portion 16 are readily manufactured using standard plastic molding techniques, whereby they are relatively inexpensive to produce, and whereby they are well suited for mass production. Further, as the parts 14, 16 are preferably made of plastic material, they can be formed in a variety of colors. Also, the ventilation openings, while formed in the shape of flower petals 66 in the preferred embodiment 10, can be any shape which allows for air flow to assist in the drying and curing of the polish on the fingernail 15.

In view of the design of the overall present fingernail polish protector, the ring portion 14 is easily adjustable to be readily, and comfortably, worn for sufficient time to permit the full curing of the underlying fingernail polish. At the same time, the tiltable shield portion 16 provides an attractive protector, yet allows for air circulation. The fact that the shield portion 16 can be snapped into position, as described, means that the manufacturing process can include a variety of ring portions 14 and interchangeable shield portions 16 of various sizes, shapes, colors, and configurations without departing from the present invention, and the tiltable aspect of the shield portion 16 means that shield portion above the fingernail can be tilted independently of the adjustment to the ring portion 14 on the wearer's finger 12. Accordingly, the shield portion 16 can be moved from an upward tilt "painting" or "open" position to a "protection" or "closed" mode, with the hexagonal shaped axle 60 of the preferred embodiment acting to stop the tilt in various positions.

While the present invention has been described in connection with specific embodiments, the inventors do not intend to restrict the description to the examples shown. Persons skilled in the art will recognize that the above designs and improvements may be modified or changed without departing from the general scope of this description. The inventors specifically intend to include all such modifications and alterations in so far as they come within the scope of the appended claims or the equivalents thereof.

We claim:

1. A fingernail polish protector, comprising:

(a) a ring portion, said ring portion including means for adjusting the size of said ring portion, whereby said ring portion can be readily fitted to the finger of a wearer, said ring portion being made of a resilient, material which is adapted to totally encircle the portion of the finger of said wearer between said fingernail and the first finger joint of a wearer, said ring portion further including means for holding and adjustably retaining a ventilated shield portion, whereby the adjustment of the fit of said ring portion is independent of the adjustment of the angle at which said ventilated shield portion is positioned;

(b) a ventilated shield portion comprising an elongated shield having at least one ventilation opening formed therethrough, whereby air is able to flow through said ventilated shield portion to enable the drying of nail polish thereunder, said ventilated shield portion including means for adjusting the tilt angle of said ventilated shield portion, in multiple, intermediate positions, relative to said ring portion, whereby the distance between said ventilated shield portion and the fingernail of said wearer can be adjusted and maintained, as desired by said wearer; and (c) means for preventing said ventilated shield portion from contacting the finger or the fingernail of said wearer, whereby the angle of said ventilated shield portion, relative to the fingernail of said wearer, can be adjusted without changing the manner in which said ring portion attaches to the finger of said wearer and whereby said ventilated shield portion is prevented from touching the finger or fingernail of said wearer.

2. The fingernail polish protector of claim 1 wherein said ring portion includes a pair of arcuate members, a first one of said pair of arcuate members including an elongated portion having a ridged section, and a second one of said pair of arcuate members including a forked section into which said elongated portion of said first arcuate member can be inserted, said forked section including an internal ridged section which interacts with and secures said ridged section of said elongated portion of said first arcuate member when said elongated portion is inserted into said forked portion, whereby said ridged sections interact to retain a ring size selected by said wearer.

3. The fingernail polish protector of claim 2 wherein said forked section further comprises a release in the form of a raised portion at the distal end thereof, said release providing said wearer with a means for easily allowing the user to loosen said ring portion on said wearer's finger.

4. The fingernail polish protector of claim 1 wherein said means for adjusting the tilt angle of said ventilated shield potion relative to said ring portion includes a substantially cylindrical axle portion attached to said ventilated shield portion and said ring portion includes means for adjustably retaining said substantially cylindrical axle portion comprising a pair of arms having sections adapted to retain said substantially cylindrical axle portion therein, said means for preventing said ventilated shield portion from contacting the fingernail of a wearer comprising a positive stop on said ring portion.

5. The fingernail polish protector of claim 4 wherein said ventilated shield portion is substantially shaped to overlie a fingernail without extending over the tip thereof.

6. The fingernail polish protector of claim 5 wherein said ventilated shield portion is tiltably affixed to said ring portion whereby said ventilated shield portion can be tilted towards or away from said wearer's fingernail without adjusting the size of said ring portion on the finger of said wearer.

7. The fingernail polish protector of claim 6 wherein said means for preventing said ventilated shield portion from contacting the finger or the fingernail of said wearer comprises said positive stop which limits the downward travel of said ventilated shield portion and prevents said ventilated shield portion from tilting downward onto a wet fingernail.

8. The fingernail polish protector of claim 7 wherein said ventilated shield portion includes downwardly curved sides which will contact the wearer's finger to limit side-to-side movement of said ventilated shield portion, thereby preventing such movement from allowing contact with the wearer's fingernail.

9. The fingernail polish protector of claim 8 wherein at least one of said ventilation openings is formed to have a decorative pattern.

10. The fingernail polish protector of claim 9 wherein said ring portion and said ventilated shield portion are manufactured from a plastic material.

11. The fingernail polish protector of claim 10 wherein said ring portion and said ventilated shield portion are manufactured by molding said plastic material.

* * * * *